US006189234B1

(12) United States Patent
Luker

(10) Patent No.: US 6,189,234 B1
(45) Date of Patent: Feb. 20, 2001

(54) CONTINUOUS FLOW FLUID BED DRYER

(75) Inventor: William A. Luker, Burnsville, MN (US)

(73) Assignee: International Technology Systems, Inc., Holton, WI (US)

( * ) Notice: Under 35 U.S.C. 154(b), the term of this patent shall be extended for 0 days.

(21) Appl. No.: 09/287,524

(22) Filed: Apr. 7, 1999

Related U.S. Application Data

(60) Provisional application No. 60/081,031, filed on Apr. 8, 1998.

(51) Int. Cl.[7] ..... F26B 17/12
(52) U.S. Cl. ..... 34/166; 34/179; 34/185
(58) Field of Search ..... 34/165, 166, 168, 34/179, 181, 182, 183, 184, 185, 186, 187, 188

(56) References Cited

U.S. PATENT DOCUMENTS

| | | | | |
|---|---|---|---|---|
| 3,808,701 | * | 5/1974 | Bachmann | 34/179 |
| 4,589,215 | * | 5/1986 | Iwasaki et al. | 34/182 |
| 4,608,766 | * | 9/1986 | Kawai et al. | 34/57 A |
| 5,144,108 | * | 9/1992 | Reynolds et al. | 219/388 |
| 5,197,205 | * | 3/1993 | Spada et al. | 34/182 |
| 5,869,810 | * | 2/1999 | Reynolds et al. | 219/388 |

OTHER PUBLICATIONS

*Process Drying Practice,* Cook & DuMont, 1991, McGraw Hill Inc., pp. 45–48 and 225–229.

* cited by examiner

*Primary Examiner*—Pamela Wilson
*Assistant Examiner*—Michelle A Mattera
(74) *Attorney, Agent, or Firm*—Burd, Bartz & Gutenkauf

(57) ABSTRACT

A continuous flow fluid bed dryer has a dryer housing having a drying chamber and a plenum chamber located beneath the drying chamber. Moist product to be dried is introduced to the drying chamber at a product inlet and proceeds through the drying chamber to a discharge housing. A porous screen partially separates the drying chamber and the plenum chamber. Heated air is introduced into the plenum chamber which then passes through the screen to the drying chamber to dry product in the drying chamber. A shaft extends centrally through the drying chamber and is mounted for slow rotation therein. A plurality of paddles are connected to the shaft. The paddles move about a path of rotation whereby paddle ends sequentially sweep over the surface of the screen. In doing so, the paddles momentarily move product away from the screen permitting a rush of heated into the drying chamber locally fluidizing the bed and further drying the product. The product is treated very gently in the process so as to suffer minimal degradation if any.

17 Claims, 6 Drawing Sheets

CONTINUOUS FLOW FLUID BED DRYER

Reference is made to U.S. provisional patent application Ser. No. 60/081,031 filed Apr. 8, 1998.

BACKGROUND OF THE INVENTION

The invention pertains to the field of direct dryers for industrial and commercial use, and in particular to a continuous flow fluid bed dryer. Such dryers are typically used for the drying of delicate free flowing products such as certain grains. Such grains tend to suffer degradation in dryers having rapidly moving mechanical parts that interact with the product. The fluid bed dryer typically has a drum or housing with a plenum region beneath a product drying region and separated from it by a porous screen. Heated air is introduced into the plenum. Particulate matter to be dried is "fluidized", that is it is suspended above the screen on the heated air rising through the screen. This produces a turbulent mixing action between the target product and the air resulting in the drying of the product without damage to it. The screen openings can be canopied to direct air flow and deter clogging of the screen openings. In such dryers the heated air flow is used both to dry the product and move it along the dryer to a discharge. The amount of air needed to fluidize the product is often greater that the amount of heated air needed to dry it. This results is wasted heat since the amount of heated air supplied is a function of the amount of air needed to fluidize the product.

SUMMARY OF THE INVENTION

The invention pertains to a continuous flow fluid bed dryer wherein portions of the bed are momentarily fluidized for drying purposes. The dryer includes a dryer housing having a dryer drum with a drying chamber, and a plenum section with a plenum chamber located beneath the drying chamber. Hot air is introduced into the plenum chamber. The lower part of the drying chamber is trough shaped with a curved bottom and relatively high side walls. A curved porous screen is located at the bottom of the drying chamber and permits hot air to be transferred from the plenum chamber to the drying chamber. A rotor shaft extends longitudinally through the drying chamber and carries a plurality of paddles. The shaft rotates slowly in the drying chamber to gently mix the product with the heated air and advance it downstream in the chamber. As each paddle sweeps across the screen it moves product away from the screen. This permits a momentary rush of air through the screen, locally fluidizing the product and promoting drying.

IN THE DRAWINGS

FIG. 1 is a side elevational view of a fluid bed dryer according to one form of the invention;

DESCRIPTION OF A PREFERRED EMBODIMENT

Figure 7:
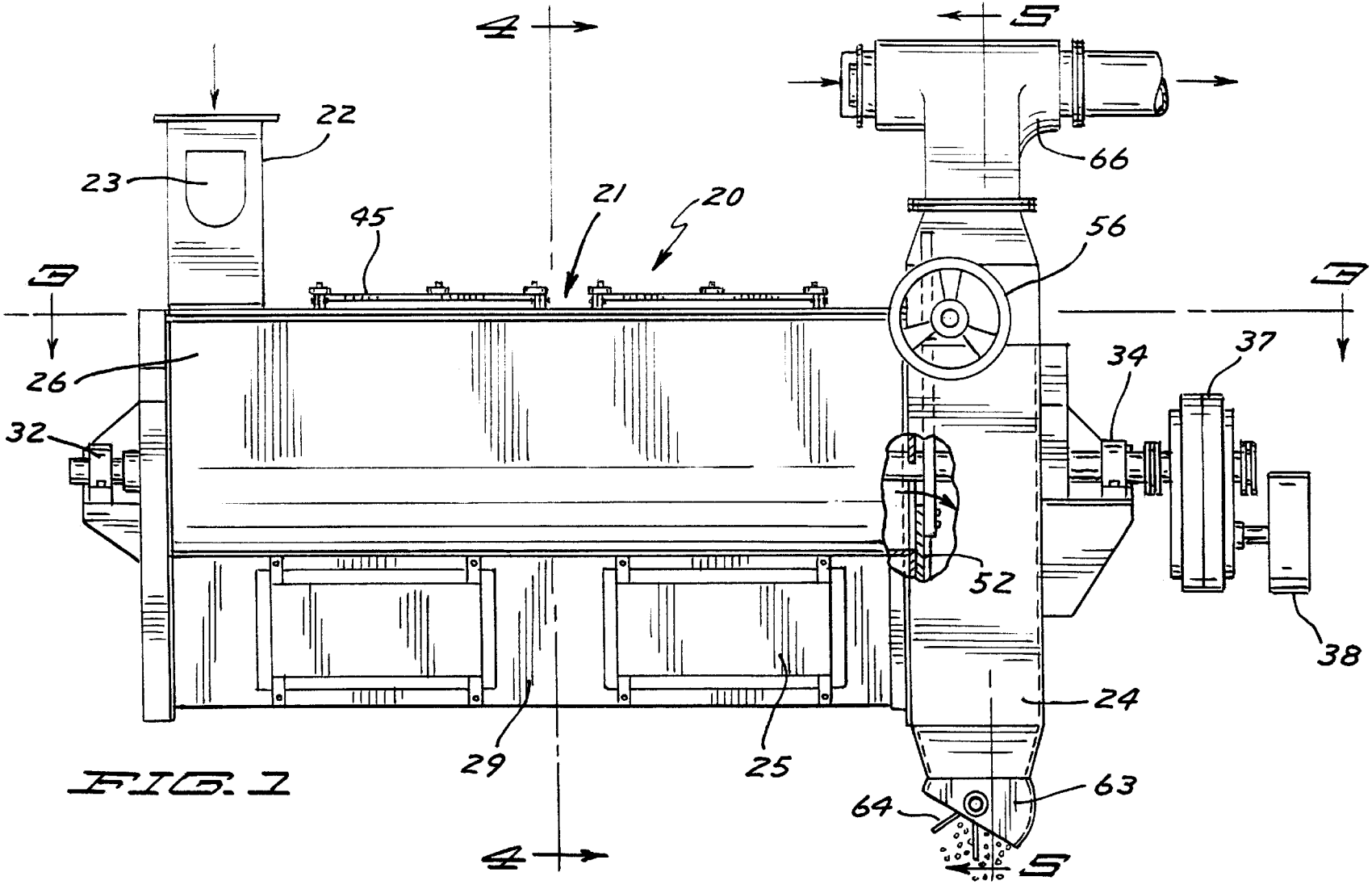
FIG. 7 is an enlarged sectional view of a portion of the screen taken along the line 7—7 of FIG. 4.
Figure 2:
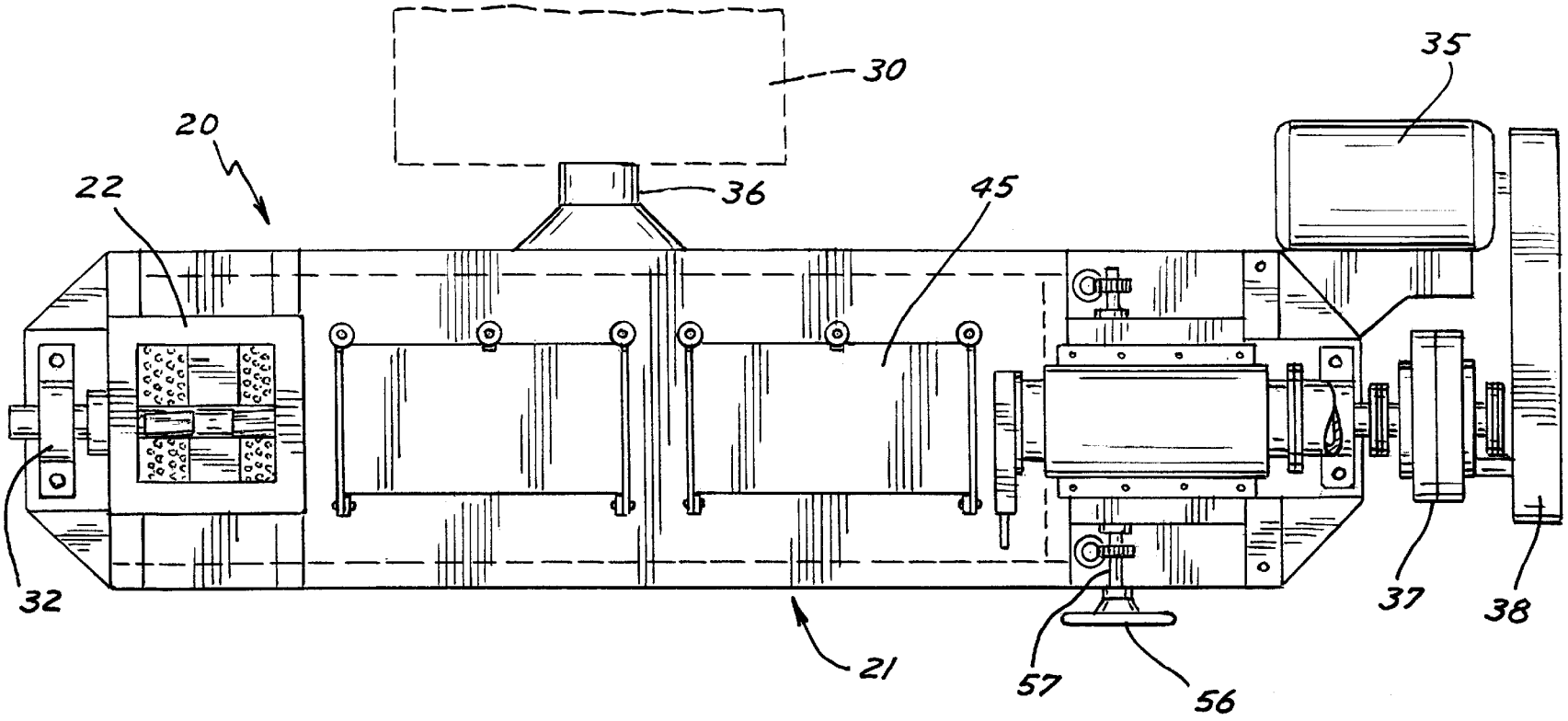
FIG. 2 is a top plan view of the dryer of FIG. 1.

Referring to the drawings there is shown a fluid bed dryer according to the invention indicated generally at 20. Dryer

20 includes an elongate dryer housing 21 disposed about a longitudinal axis and connected to a product inlet chute 22 at a first or upstream end, and a discharge housing 24 at a second or downstream end. Product to be dried is carried to the inlet chute 22 by suitable conventional or preferred means such as an auger indicated at 23 in FIG. 1. Product leaves dryer housing 21 through a product outlet opening 33 (FIG. 6) to enter discharge housing 24.

The dryer housing 21 includes a dryer drum 26 and a plenum section 29 located beneath the dryer drum 26. The dryer drum 26 has a longitudinal drying chamber 27. The plenum section 29 has a plenum chamber 28. One or more hot air inlets 36 open through a wall of the plenum section 29 into the plenum chamber 28 for admitting hot dry air heated air from a suitable source shown in phantom as a hot air furnace 30. Access doors 25 open through another wall of plenum section 29 for cleaning and repair purposes.

A rotor shaft 31 extends the length of dryer drum 26 in the drying chamber 27 and is mounted for axial rotation therein. The ends of shaft 31 are carried by pillow block bearings 32, 34 at either end thereof and exterior to the dryer housing 21. Shaft 31 is rotated by an electric motor 35 connected to it by a gear transmission assembly 37 and drive belt assembly 38. (Motor 35 is shown on the right side of dryer housing 21 in FIG. 1 but could be mounted on either side.)

Both drying chamber 27 and plenum chamber 28 extend substantially the length of the dryer housing 21. A screen 40 partially separates the plenum chamber 28 from the drying chamber 27 in order to permit fluid communication from the plenum to the drying chamber. A section of the screen is shown in FIG. 7. The screen has a plurality of openings 41. The openings are preferably "canopied". That is, the openings are formed with a cover 42 so as to be directional. As situated in the dryer housing 21, the openings are forwardly directed or face in the direction of the discharge housing. This promotes movement of the product in a downstream direction. The canopy over each opening inhibits clogging and directs the air forward. The density and size of the openings determine the porosity of the screen. Screen porosity will vary according to the application of the dryer.

Dryer drum 26 is U-shaped with vertical side walls 43 and a top wall 44. Access doors 45 are provided for interior access. The bottom of dryer drum 26 is curved or trough shaped. Screen 40 is curved and comprises a major portion of the profile of the bottom of the drying chamber 27. Screen 40 extends the length of the drying chamber and can be curved about an arc having a center at shaft 31.

Figures 4, 7:
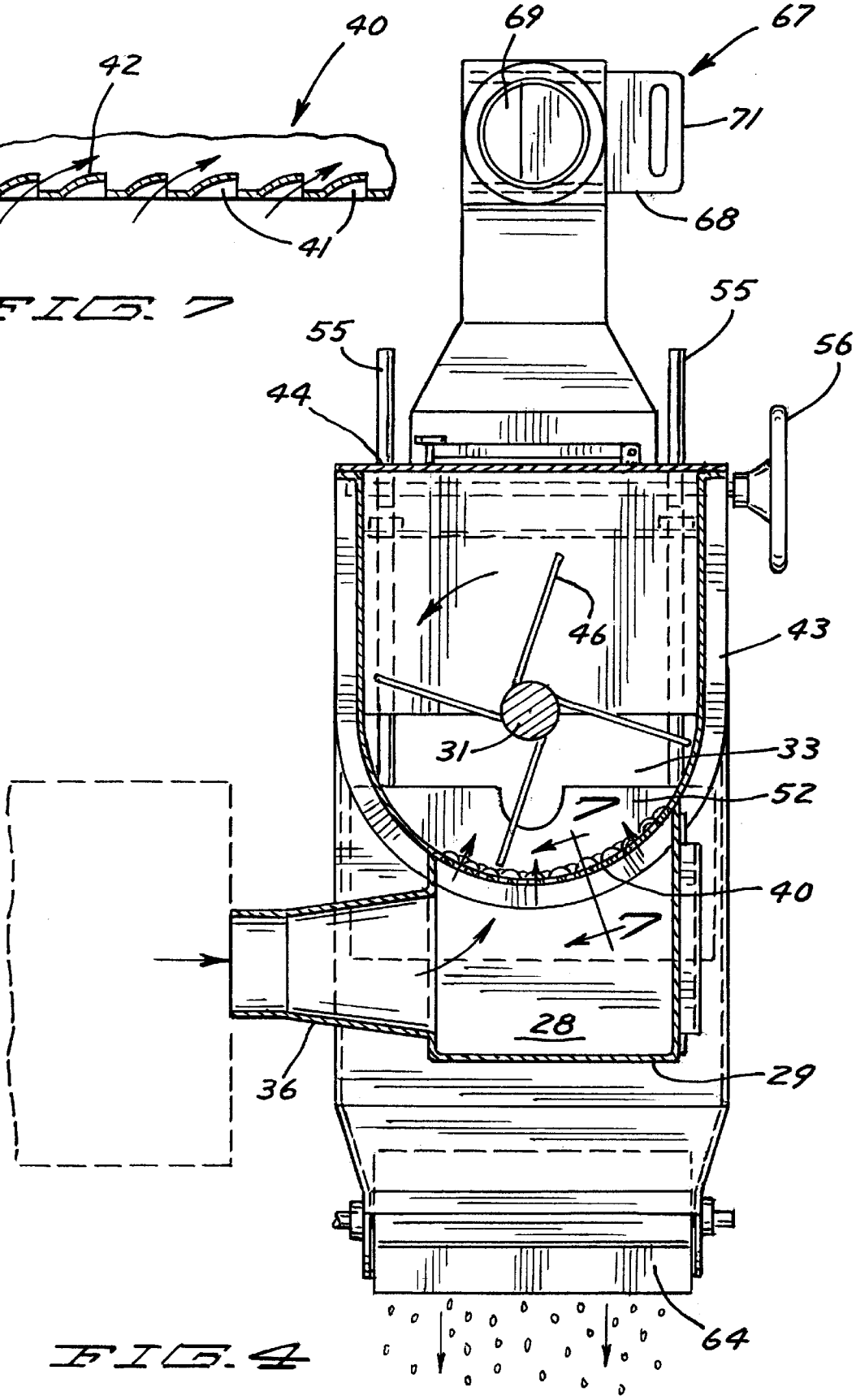
FIG. 4 is an enlarged sectional view of a portion of the dryer of FIG. 1 taken along the line 4—4 thereof.

Shaft 31 extends longitudinally through the drying chamber 27. The shaft 31 has a plurality of blades or lifting paddles 46 attached to it. As shown in FIG. 4, the paddles have a radial length such that upon rotation of the shaft 31 the tips of the paddles sweep close to the bottom wall of the drying chamber 27 including the upper surface of screen 40. As shown in FIG. 4, the screen 40 is higher along the upsweep side of the bottom of the drying chamber. This exposes more air flow to a greater mass of product in the bed.

Figure 3:
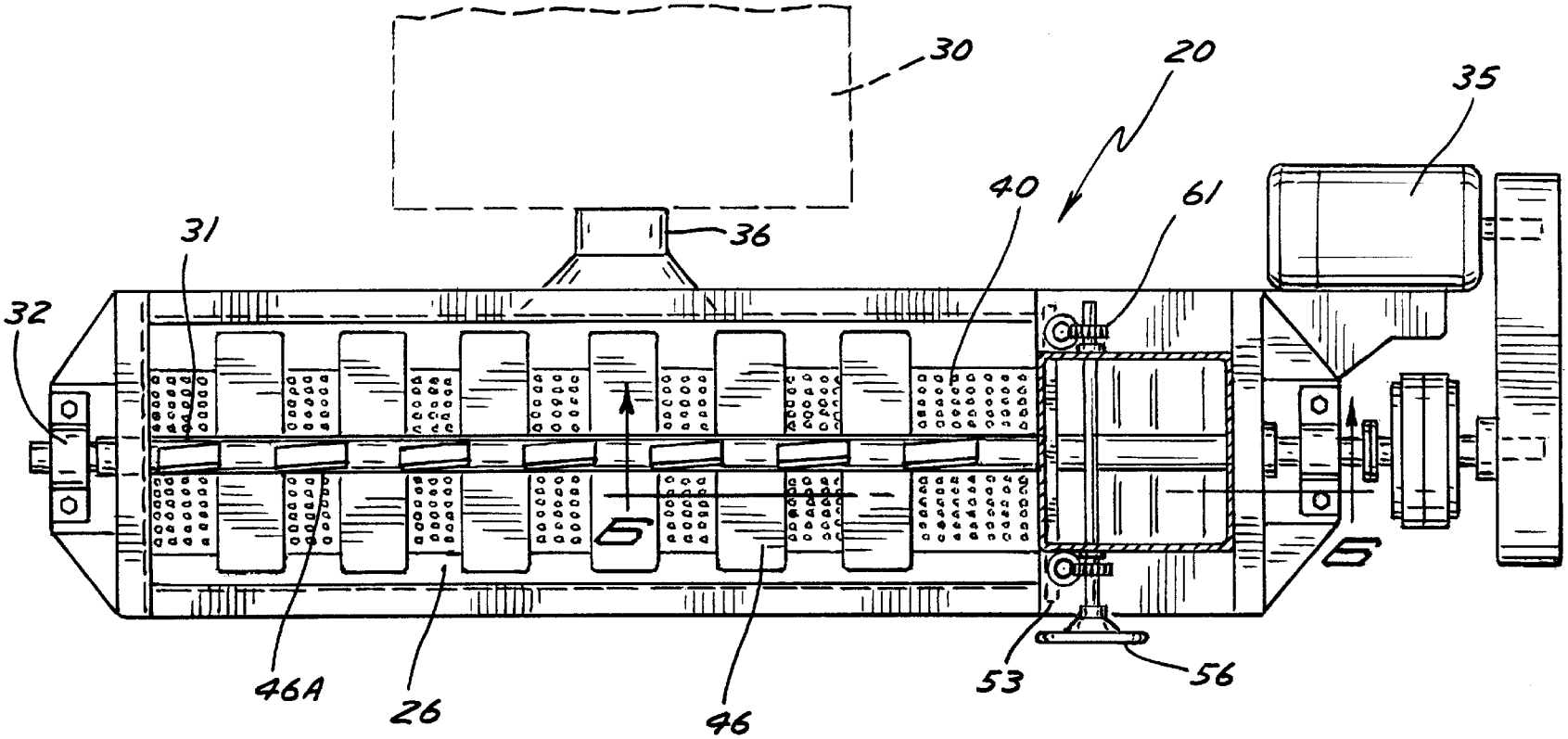
FIG. 3 is an enlarged sectional view of a portion of the dryer of FIG. 1 taken along the line 3—3 thereof.

FIG. 3 shows that the paddles 46 are symmetrically arranged along the length of shaft 31. Chords of the paddles overlap along the length of the shaft 31. The paddles 46 are arranged in opposing pairs on the shaft 31. As shown at 46A in FIG. 3, each paddle chord is canted forwardly. Upon rotation of the shaft 31, this promotes movement of product in a forward or downstream direction.

The paddles are fixed to the shaft 31 in diametrically offset fashion. This is shown in FIG. 3 but is better seen by the sectional views of the shaft of FIGS. 4 and 5. The radial axis of the paddle is not aligned with a diameter of the shaft 31, but is offset or tangentially displaced from it in the direction of rotation of the shaft (indicated by the arrow in FIG. 4). This increases the efficiency of the paddle as it sweeps the bottom of the drying chamber 27. Product that is carried over the top of the shaft will tend to fall on the opposite side of the shaft as it rolls off the paddle.

Product introduced through the inlet housing is indicated at 48. The moisture laden product 48 drops into the top of the drying chamber 27 at the rear or upstream end thereof. Shaft 31 is rotated at a slow to moderate speed of 10 to 20 rpm. Hot dry air is introduced through the hot air inlet 36. The air will typically be at 100° to 500° F. This air accumulates in the plenum chamber then passes upwardly through the screen 40 in to the drying chamber 27 circulating around product 48. The paddles 46 sweep the screen and move the product, rotating it in the drying chamber. This further exposes the product to the heated air while treating it very gently.

Product 48 is continuously dried as it moves forward or downstream in the drying chamber 27. Downstream movement is accomplished by the continuous feeding of additional product through the inlet housing; the directional attitude of the air openings 41 of the screen 40; and the forward cant of the paddles 46.

Figure 5:
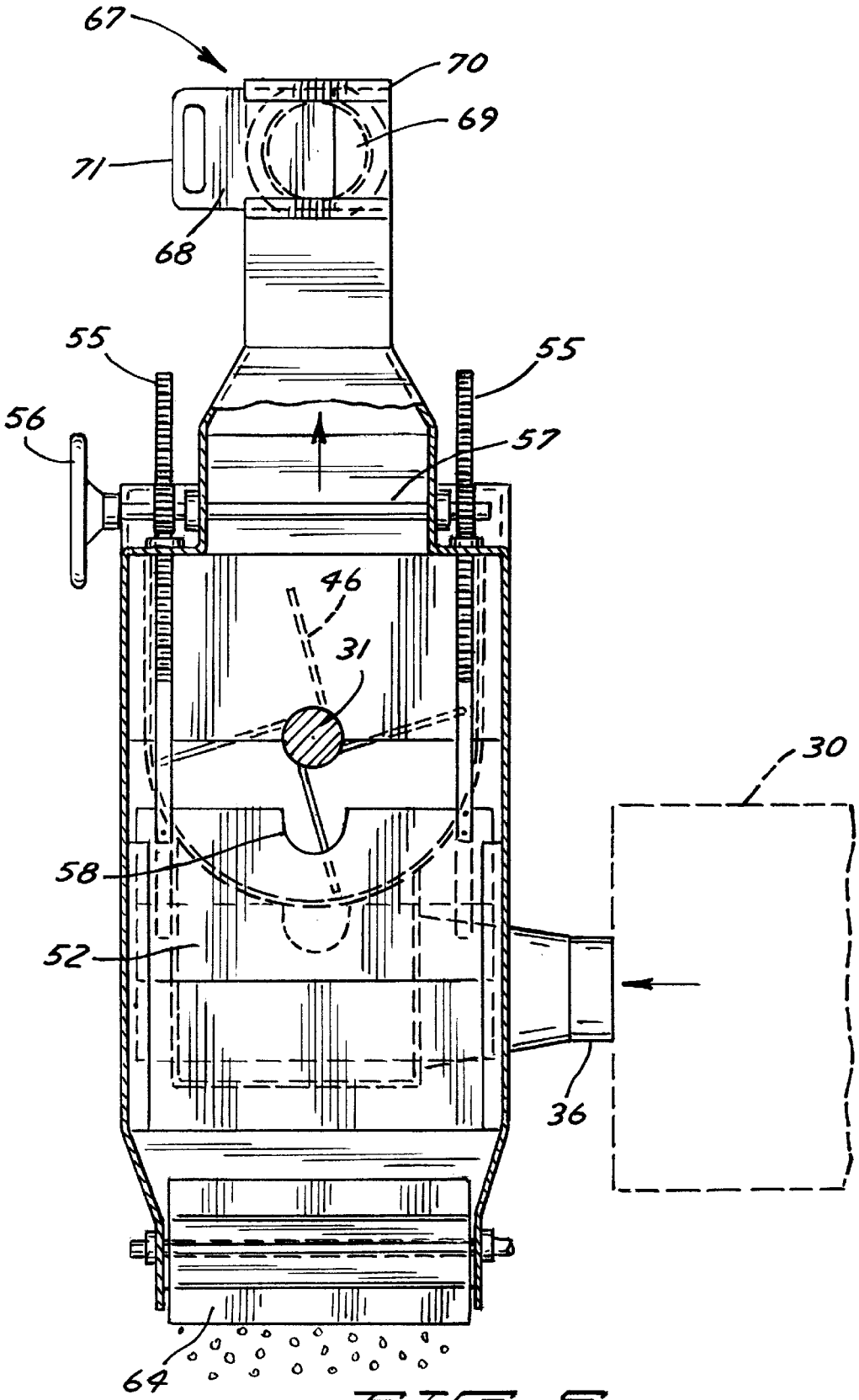
FIG. 5 is an enlarged sectional view of a portion of the dryer of FIG. 1 taken along the line 5—5 thereof.
Figure 6:
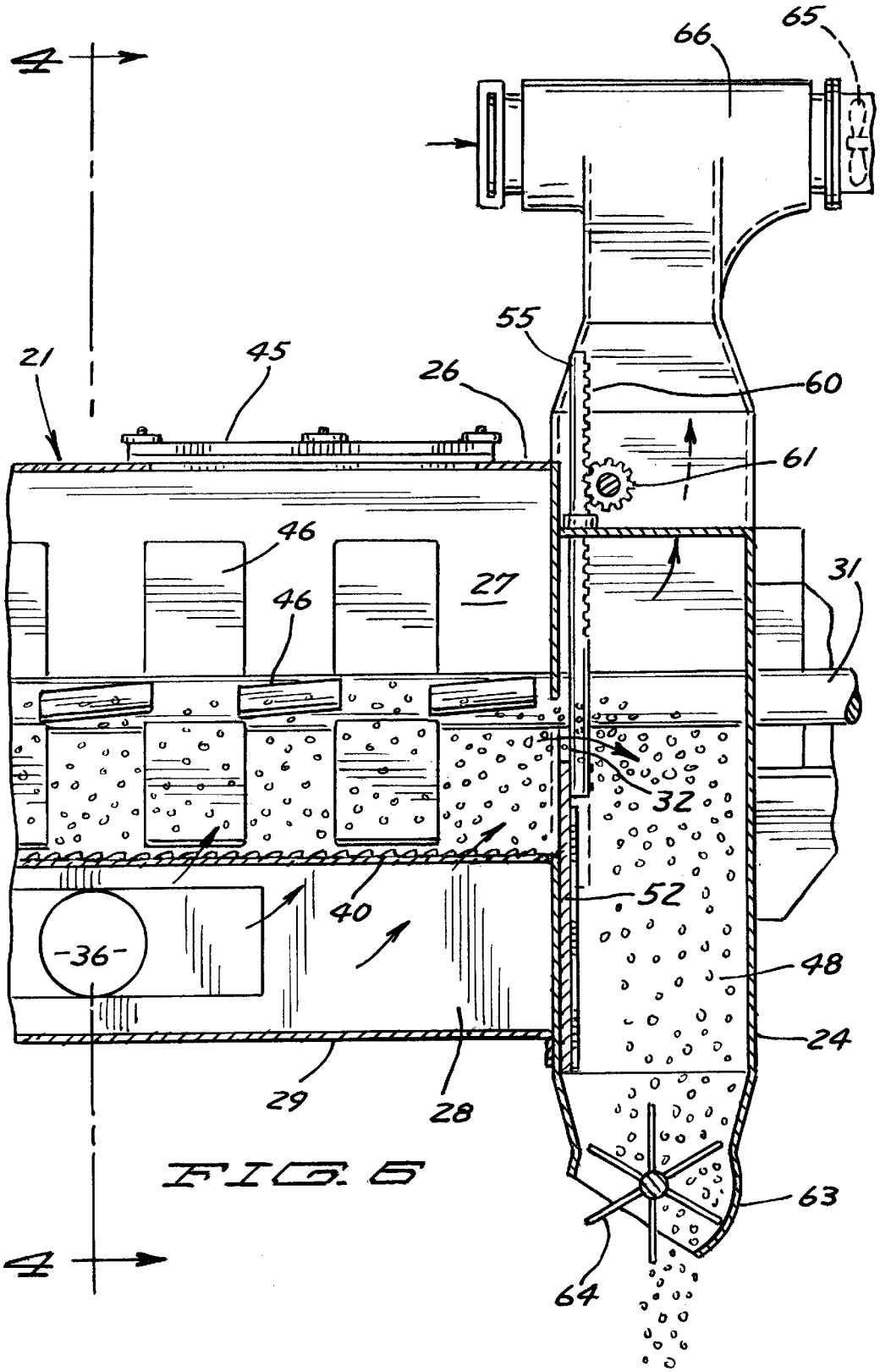
FIG. 6 is an enlarged view in section of the downstream end of the dryer taken along the line 6—6 of FIG. 3.

A movable gate or weir 52 is located at the end of the dryer drum 26 positioned to regulate product movement from the trough of the drying chamber into the discharge housing. Weir 52 is shown in FIGS. 5 and 6, and is movable into and out of partially blocking relationship with respect to the outlet product outlet 33. Weir 52 moves up and down from the lower edge of product outlet 33. In FIG. 5 weir 52 is shown in the fully up position in full lines, and in a partially down position in broken lines. Drying of product in the drying chamber is partially a function of retention time in the chamber. The position of weir 52 provides one control over retention time of the product in the drying chamber. In order to leave the drying chamber, the product must pass over the top edge of weir 52. The higher the elevation of the weir 52, the greater the amount of product that is retained in the drying chamber and accordingly the longer the retention time.

As shown, in the fully up position of FIG. 5, the top edge of weir 52 can be in approximate diametric alignment with shaft 31. The top edge of weir 52 has an indentation 58 that accommodates shaft 31 when the weir is fully raised. Weir 52 could be configured so that the top edge could extend even higher.

Weir 52 is elevated and lowered by means of a rack and pinion arrangement that includes a pair of vertical bars 55 disposed on opposite sides of dryer housing 21 at the downstream end thereof. The bars 55 carry linear gears 60. A control wheel 56 is mounted on a horizontal shaft 57 carrying circular gears 61 that are in meshing engagement with the linear gears 60. Shaft 57 is rotatably assembled to housing 21. The bars 55 are connected to the top edge of weir 52. The vertical edges of weir 52 ride in tracks 53 (FIG. 3). Rotation of the control wheel 56 raises and lowers the weir 52 between upper and lower limits.

FIG. 6 shows the weir 52 at an intermediate position. Product 48 flows over the top edge of the weir 52 and drops down the discharge housing 24. The product is discharged through an air lock 63 of the type having a compartmentalized rotating cylinder that moves product from inside discharge housing 24 to a location outside of it for transport to a further processing location by suitable means (not shown). Relatively cooler and moister air is drawn upward in the discharge housing 24. A suction blower or fan 65 draws the air through an exhaust pipe 66 at the top of discharge housing 24. Fan 65 is one control of the air volume passing through the dryer housing 21. This volumetric flow is also regulated by a slide valve 67 shown in FIG. 5 installed in a bypass opening 69 opposite exhaust 66. A plate 68 having a handle 71 is manually movable over the by-pass opening 69 (FIG. 5). Opening the plate 68 permits air to be drawn through the by-pass opening 69 and lessens the volume of air drawn through the dryer housing.

In operation, shaft 31 is operated at low rpm so that the paddles 46 sweep through the bed of product 48 that is located in dryer drum 21 and continuously being introduced through inlet 22. Hot air enters the plenum section through inlet 36. The hot air fills the plenum chamber and continuously moves through the screen to the drying chamber. As a paddle sweeps over a section of the screen 40, it moves product away from the screen section with a consequent localized rush of air through the screen. There is a momentary fluidizing of the product at that locale resulting in mixing and drying of the material. The advantages of a fluidized bed dryer are realized without fluidizing the entire bed at once. Paddle movement is slow and gentle. Product moves forward to the discharge opening. Since the entire bed is not fluidized, the particles are not classified by weight or size. Varying size particles remain mixed together. The high sidewalls of the drying chamber leave a large upper area where air flow is considerably lessened. This avoids separation of the lighter and smaller particles from the bed.

The embodiments of the invention in which an exclusive property or privilege is claimed are described as follows:

1. A continuous flow fluid bed dryer for drying of particulate product, comprising:

a dryer housing having housing walls defining a drying chamber and a plenum chamber located beneath the drying chamber;

a product inlet to the drying chamber and a product outlet from the drying chamber;

a porous screen separating the drying chamber from the plenum chamber between the product inlet and the product outlet;

an heated air inlet to the plenum chamber for introduction of heated air for movement through the plenum chamber to the drying chamber;

a rotor shaft mounted for axial rotation in the drying chamber, and means for rotation of the shaft;

a plurality of paddles connected to the rotor shaft for movement about a path whereby the paddle ends sequentially sweep over the surface of the screen to move product away from the screen permitting a rush of heated air into the drying chamber from the plenum chamber;

said paddles connected to the shaft in an arrangement whereby the chords of adjacent paddles overlap along the length of the shaft; and means for movement of the product in a downstream direction between the product inlet of the drying chamber and the product outlet.

2. The fluid bed dryer of claim 1 wherein:

said dryer housing includes a U-shaped dryer drum having vertical side walls and a trough shaped bottom defining said drying chamber, and a plenum section having said plenum chamber;

a least a portion said trough shaped bottom of the dryer drum including said screen.

3. The fluid bed dryer of claim 2 wherein:

said shaft extends parallel to a longitudinal axis of the dryer drum, said paddles mounted on the shaft having a length to sweep along the surface of the porous screen upon rotation of the shaft in the drying chamber.

4. The fluid bed dryer of claim 3 wherein:

the paddles are mounted on the shaft with chords canted forwardly to promote downstream movement of product in the drying chamber upon rotation of the shaft.

5. The fluid bed dryer of claim 3 wherein:

said porous screen had canopied openings directed in the downstream direction.

6. The fluid bed dryer of claim 4 including:

a discharge housing, said product outlet from the dryer housing open to the discharge housing;

a weir assembly connected to the dryer drum and including an adjustably positioned weir movable into and out of partial blocking relationship to the product outlet in order to regulate retention time of product in the drying chamber.

7. A continuous flow fluid bed dryer for drying of particulate product, comprising:

a dryer housing having a dryer drum and a plenum section located beneath the dryer drum;

said dryer drum being U-shaped with vertical side walls and a trough shaped bottom defining a longitudinal drying chamber;

said dryer drum having a product inlet at an upstream end of the drying chamber, and a product outlet at a downstream end of the drying chamber;

said plenum section defining a plenum chamber located beneath the drying chamber of the drying drum;

a curved porous screen comprising at least a part of the bottom of the dryer drum permitting air flow from the plenum chamber to the drying chamber;

a heated air inlet to the plenum section for introduction of heated air into the plenum chamber for movement through the plenum chamber to the drying chamber;

a rotor shaft located in the drying chamber parallel to the longitudinal axis of the drying chamber and mounted for axial rotation;

means for axial rotation of the shaft;

a plurality of paddles connected to the shaft for rotation with the shaft;

said paddles having a radial length sufficient such that upon rotation of the shaft, the tips of the paddles sweep close to the bottom wall of the drying chamber including the porous screen to locally move product away from the screen and permit a rush of heated air from the plenum chamber to momentarily fluidize the product in the vicinity;

said paddles connected to the shaft in an arrangement whereby chords of adjacent paddles overlap along the length of the shaft.

8. The fluid bed dryer of claim 7 wherein:

the means for axial rotation of the shaft can rotate the shaft at between 10 and 20 rpm.

9. The fluid bed dryer of claim 7 wherein:

the paddles are mounted on the shaft with chords canted forwardly to promote downstream movement of product in the drying chamber.

10. The fluid bed dryer of claim 9 wherein:

said porous screen has canopied openings directed in the downstream direction.

11. The fluid bed dryer of claim 10 wherein:

the paddles are attached to the shaft in diametrically offset fashion in the direction of rotation of the shaft.

12. The fluid bed dryer of claim 11 wherein:

chords of the paddles overlap along the length of the shaft.

13. The fluid bed dryer of claim 11 including:

a weir assembly connected to the dryer drum and including an adjustably positioned weir movable into and out of partial blocking relationship to the product outlet in order to regulate retention time of product in the drying chamber.

14. The fluid bed dryer of claim 13 wherein:

the weir is movable into and out of blocking relationship with respect to the product outlet from a bottom edge of the product outlet whereby product moves over a top edge of the weir.

15. The fluid bed dryer of claim 14 including:

a rack and pinion assembly for movement of the weir.

16. The fluid bed dryer of claim 14 wherein:

the means for axial rotation of the shaft can rotate the shaft at between 10 and 20 rpm.

17. The fluid bed dryer of claim 16 wherein:

the paddles are mounted on the shaft with chords canted forwardly to promote downstream movement of product in the drying chamber upon rotation of the shaft.

* * * * *